US005259743A

United States Patent [19]

Glaser

[11] Patent Number: 5,259,743

[45] Date of Patent: Nov. 9, 1993

[54] SPINNING MACHINE FOR WET-SPINNING PROCESS

[75] Inventor: Gerhardt Glaser, St. Pölten, Austria

[73] Assignee: Glanzstoffe Austria Aktiengesellschaft, Polten, Austria

[21] Appl. No.: 743,042

[22] Filed: Aug. 9, 1991

[30] Foreign Application Priority Data

Aug. 10, 1990 [AT] Austria ..... 1679/90

[51] Int. Cl.[5] ..... D01D 5/06; D01D 10/04

[52] U.S. Cl. ..... 425/66; 264/197; 264/198; 425/68; 425/71; 425/366; 425/404

[58] Field of Search ..... 264/188, 197, 198; 425/67, 68, 71, 325, 366, 404, 445, 446, 66

[56] References Cited

U.S. PATENT DOCUMENTS

| | | | |
|---|---|---|---|
| 1,992,897 | 2/1935 | Elssner et al. | 264/197 |
| 2,107,451 | 2/1938 | Oppenlaender | 425/66 |
| 2,155,324 | 4/1939 | Moritz | 264/198 |
| 2,346,696 | 4/1944 | Moritz et al. | 264/197 |
| 2,526,110 | 10/1950 | Barker et al. | 264/198 |
| 2,570,173 | 10/1951 | Von Kohorn | 264/198 |
| 2,591,243 | 4/1952 | Drisch et al. | 264/198 |
| 2,788,256 | 4/1957 | Allen | 264/198 |
| 2,867,108 | 1/1959 | Severini | 264/188 |
| 2,984,889 | 5/1961 | Braunlich et al. | 264/197 |
| 4,477,951 | 10/1984 | Geyer, Jr. et al. | 264/197 |

FOREIGN PATENT DOCUMENTS

| | | | |
|---|---|---|---|
| 746281 | 6/1944 | Fed. Rep. of Germany . | |
| 484438 | 9/1953 | Italy | 264/198 |
| 772865 | 4/1957 | United Kingdom . | |

OTHER PUBLICATIONS

Moncrieff, R. W.—Man Made Fibres—GB, London, 1975, pp. 185–187.

*Primary Examiner*—Jay H. Woo
*Assistant Examiner*—James P. Mackey
*Attorney, Agent, or Firm*—Herbert Dubno

[57] ABSTRACT

A wet-spinning process for producing filament utilizes a pair of rollers in the spinning machine which have axes which are skewed to one another, i.e. include angles in projections both in vertical and horizontal planes and so inclined that the interturn spacing of the filament decreases from the upstream wet zone to the downstream drying zone.

6 Claims, 2 Drawing Sheets

SPINNING MACHINE FOR WET-SPINNING PROCESS

FIELD OF THE INVENTION

My present invention relates to a spinning machine for the continuous production of filaments and, more particularly, to a machine for continuously spinning a filament by a wet-spinning process with or without an air gap and wherein the spun filament from the coagulating bath or the spinning nozzle passes onto at least one roller pair formed by elongated rollers having their axes inclined to one another so that the turns of the filament progressively pass along these rollers from a wet zone to drying zone downstream of the wet zone.

BACKGROUND OF THE INVENTION

Götze, "Chemiefasern nach dem Viskoseverfahren", 3. Auflage, 1967, page 900, Verlag-Springer, Berlin, Heidelberg, New York (Chemical Fibers According to the Viscose Process) describes a system in which freshly formed filaments from a spinning nozzle or spinneret are drawn from a coagulation bath by a roller pair. The filament passes in a helical pattern over the roller pair whose rollers have coplanar axes which are not, however, parallel to one another but rather include an angle with one another.

The threads looped over the roller pair move progressively therealong toward the imaginary intersection point of the two axes and automatically distribute themselves along the rollers to pass from the wet zone to a drying zone.

The wet zone encompasses that region of the path of the turns over the rollers in which filament or thread consolidation takes place and can include a deacidification zone in which the turns of the threads can be washed to free them from the acid. The drying zone encompasses a heated region of the rollers. The angular orientation of the roller axes ensures a constant spacing of the thread turns which can be about 6 millimeters from turn to turn over the entire length of the rollers.

This large spacing of the thread turns is important in the wet region or zone to avoid sticking of the turns together. Once the threads have consolidated, however, and especially in the drying zone, there is no longer a need for such a large spacing although it is in the nature of earlier systems of this type that such spacings are provided in the drying zone as well.

What is important for the drying zone is that the thread remain for a sufficient residence time in contact with the heated length of the rollers that the drying can be effected in a reliable manner. In the past, the constant spacing of the turns required rollers of considerable length to ensure a sufficient residence time in the drying zone.

OBJECTS OF THE INVENTION

It is, therefore, the principal object of the present invention to provide a spinning machine for the type described which can ensure a sufficient spacing of the turns in the wet zone (a spacing amounting to 4 to 6 millimeters, for example, in the case of 110 dtex filaments) while nevertheless enabling a smaller spacing of the turns in the drying zone or downstream of the wet zone.

Another object of the invention is to provide a spinning machine of the aforedescribed type which can provide a minimum spacing of the turns of the filament in the drying zone with a progressive reduction in the interturn spacing at least along the drying zone.

Still another object of the invention is to provide a spinning machine of the type described which can afford better utilization of the drying energy, optimum production speed and reliable production of a wet spun filament, utilizing a roller pair of reduced length.

SUMMARY OF THE INVENTION

These objects and others which will become apparent hereinafter are attained, in accordance with the present invention in an apparatus of the type described but wherein the axes of the roller pair are skew to one another, i.e. the axes include angles with one both in a horizontal projection (on a vertical reference plane) and in a vertical projection (on a horizontal reference plane).

More particularly, the apparatus can comprise:

means for wet-spinning an extruded filament;

at least one roller pair of mutually inclined longitudinally extending rollers for receiving the extruded filament and processing same, the roller pair defining axially therealong a wet zone initially receiving the filament and a drying zone downstream of the wet zone in a direction of travel of successive turns of the filaments looped around the rollers of the pair, the turns progressively advancing in the direction along the rollers, axes of the rollers being skew to one another and having projections in a vertical plane including an angle between them and projections in a horizontal plane including an angle between them.

When the axes include an angle with one another not only in a projection on a vertical plane but also are oriented so that they do not lie in a common vertical plane, i.e. are truly skewed to one another, by determination of the angles and selection of the roll diameters and the axial spacing of the rollers, I am able to achieve a filament travel pattern in a multiplicity of turns over the rollers of the pair whereby the interturn spacing in the wet zone or the upstream portion of the rollers is large and can progressively reduce, e.g. in a continuous or monotonic relationship, to and through the drying zone.

In practical terms, therefore, I can operate with a spacing between the turns of 6 millimeters at the beginning or upstream end of the wet zone and reduce the interturn spacing to say 0.5 millimeters in the drying zone, all with a roller pair of comparatively small length and with substantially reduced energy consumption, especially for the roller heating in the drying zone. As a consequence, the overall efficiency of the process can be greatly improved.

According to a feature for the invention, the rollers of the pair are constituted as a main roller of relatively large diameter and an auxiliary roller of relatively small diameter, the ratio of the auxiliary roller diameter to the main roller diameter being substantially 1:2 to 1:4 and preferably 1:3 to 1:4.

In practice it has been found to be advantageous to provide, with a horizontal orientation of the axis of one of the rollers, for example, the main roller, the axis of the other roller, for example, the auxiliary roller, so that vertical projections of the axes will intersect approximately one-third of the way along the lengths of the rollers in the direction of travel of the turns (more generally between one-quarter and one-half of the way from the upstream end) and in the region of the wet zones. The coordinates of the axial bearing locations of the auxiliary roller can deviate in two coordinate directions from the axial bearing positions of an imaginary roller parallel to the main roller.

To improve the thread contraction and stretching and elongation on coagulation, the consolidation, the washing phase and the drying phase, at least one of the rollers of the pair can be formed with a conical section over a portion of its axial length, preferably in the deacidification zone. This conical portion can widen in the direction of travel of the turns, i.e. can diverge toward the drying zone. If desired, the other roller, especially the auxiliary roller, can have a diameter profile along its length which remains in proportion to the diameter profile along the length of the main roller which can be provided with that frustoconical portion if desired.

BRIEF DESCRIPTION OF THE DRAWING

The above and other objects, features and advantages of my invention will become more readily apparent from the following description, reference being made to the accompanying highly diagrammatic drawing in which.

SPECIFIC DESCRIPTION

Figure 2:
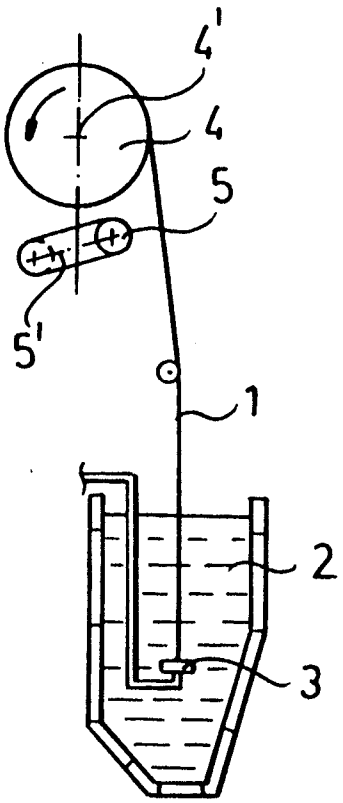
FIG. 2 is an end view of the spinning machine complete with the coagulation bath and the spinning nozzle, spinneret or orifice means.

A viscose thread 1 (FIG. 2) is formed in a coagulation bath 2 by means of a spinneret 3 from which the viscose is extruded. The thread 1, together with entrained coagulating agent from the bath 2, is drawn upwardly and winds in turn about a roller pair formed by a main roller 4 and an auxiliary roller 5.

Figure 4:
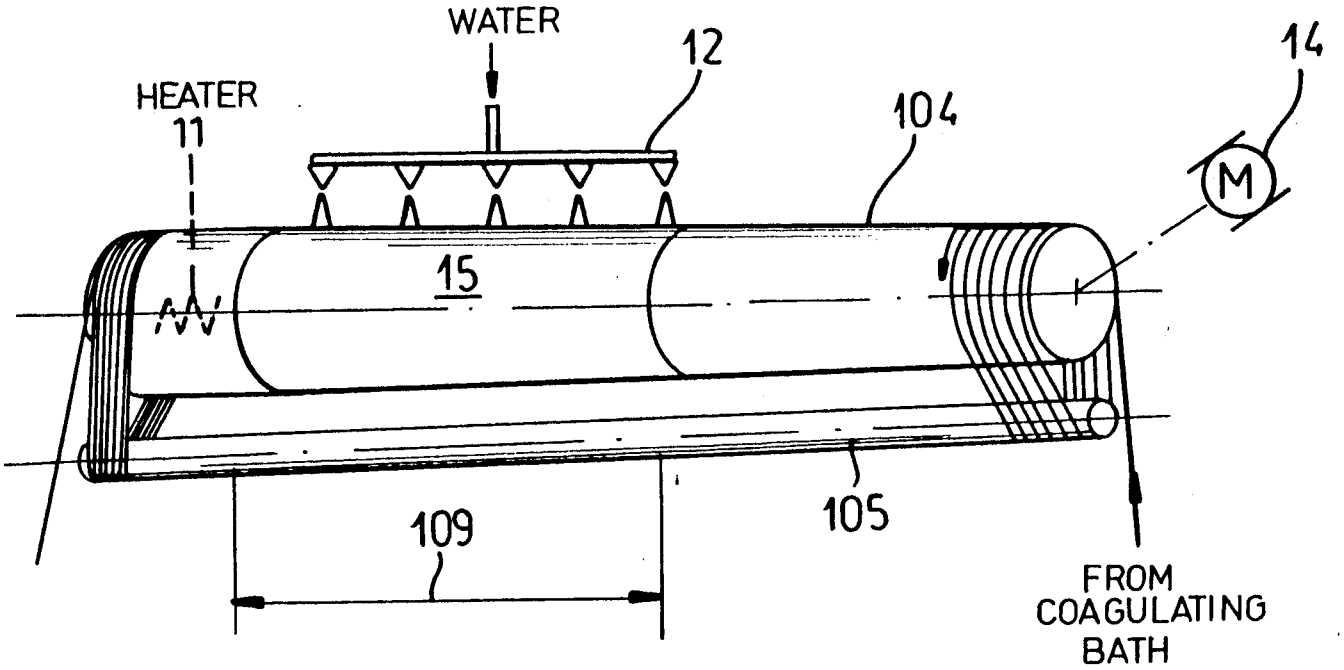
FIG. 4 is a view similar to FIG. 1 illustrating an embodiment in which the deacidification zone of the main roller has a conical configuration.

The treatment path along the main roller 4 encompasses a wet portion or zone 6 which can extend approximately over three-fourths of the length of the main roller and a heated drying zone 7 which may, as seen in FIG. 4 at 11, be equipped with a heater.

In the wet zone 6, an acid treatment phase over a zone 8 for thread consolidation, followed by deacidification in a washing or deacidification zone 9, precede the drying zone 7.

The axis 5' of the auxiliary roller 5 is inclined to the axis 4' of the main roller 4 in a projection in a vertical plane (FIG. 1) and additionally is twisted out of the vertical plane (FIG. 3) so that it includes an angle in a projection on a horizontal plane as well.

Figure 1:
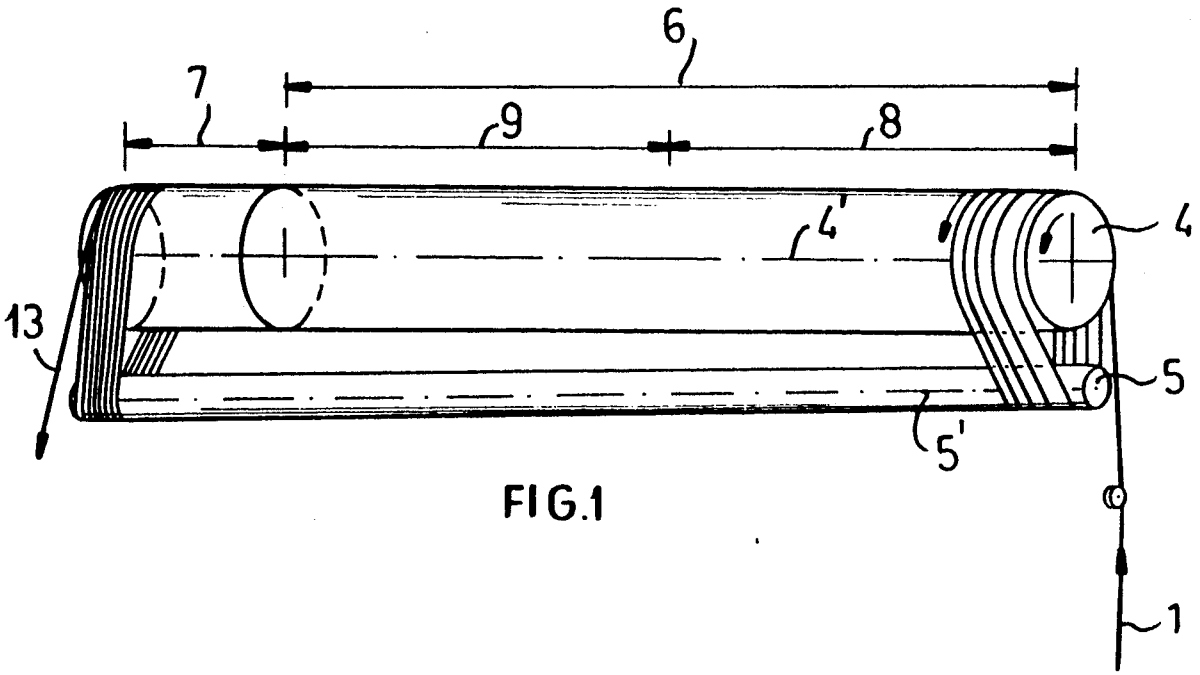
FIG. 1 is a side elevational view diagrammatically showing a pair of rollers for use in a spinning machine according to the invention and wherein the axes of the two rollers are seen as if in projection in a vertical onto a vertical plane corresponding, in this case, to the plane of the paper.
Figure 3:
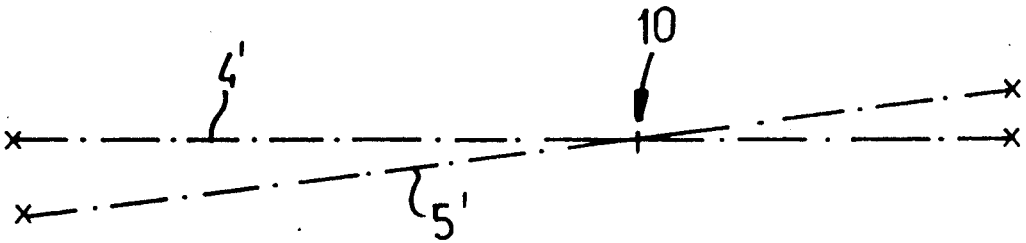
FIG. 3 is a plan view showing the orientations of the roller axes only as if in a vertical projection on a horizontal plane corresponding to the plane of the paper in this figure.

The inclination of the axis 5' relative to the horizontal can be seen readily from FIG. 1 while the twist of the axis 5' out of the vertical plane of the axis 4' is best seen in the plan view of FIG. 3.

FIG. 3 also shows that the axes of the main roller 4 and the auxiliary roller 5 are skew to one another.

This arrangement gives rise to a thread travel along the rollers with a progressively decreasing interturn spacing.

Thus I can ensure that in the thread consolidation zone or acid zone 8, in which significant quantities of the acidic coagulation bath are entrained along with the filament, successive turns will not contact one another and stick together. In the washing zone, nozzles, e.g. (the nozzles 12 shown in FIG. 4) can be provided so that water can be directed onto the filament, now already consolidated, for deacidification. The winding spacing in the zone is substantially less than the drying zone, the turns come close together as can be readily seen from FIG. 1 to reach their minimum spacing just before the dried filament is withdrawn at 13. Because of the close spacing, optimum drying can be effected over a limited portion of the length of the roller pair.

By varying the mutual inclinations of the axes, the winding spacing can be increased or reduced. If it is desired to stretch or elongate the filament during the washing process, the main roller 104 and, if desired, the auxiliary roller 105 can have slightly conical regions which widen in the direction of the drying zone as has been shown at 15 for the main roller 104 in FIG. 4. This conical region can be limited to the zone 109 in which deacidification is effected. This zone can extend from the intersection point 10 to the heated drying zone 7.

The rollers can be driven as represented by the motor 14 in FIG. 4.

By way of a specific example, the diameter of the main roller 1 was about 180 millimeters and that of the auxiliary roller about 50 millimeters.

With respect to the coagulation bath side (FIG. 2) the downstream end of the axis 5' of the auxiliary roller was located about 136 millimeters below the corresponding end of the axis 4' of the main roller and about 61 millimeters to the left while at the coagulation bath side the auxiliary roller axis 5' was located about 113 millimeters below the main roller axis 4' and about 52 millimeters to the right of the vertical plane of the axis 4'. The intersection point in projection on a horizontal plane of the two axes was located in the first quarter of the roller lengths toward the coagulation bath side. The lateral spacing of the first helical turns in the region 8 (FIG. 1) for 110 dtex filament amounted to about 9 millimeters and reduced continuously over the length of the rollers to a spacing of the last turn in the region 7 of about 0.8 millimeters. The interturn spacing is determined by the angle at which roller axes cross and could be adjusted as a function of the roller diameters and roller spacing for all spinning titers.

With the same roller spacing but with the roller axes in a common plane, utilizing a 110 dtex yarn, the minimum interturn spacing of 4.5 millimeters was held uniformly over the length of the rollers and for the same drying length as that used with the invention of 270 millimeters, only 60 turns could be accommodated, corresponding to 36% of the number of turns which could be accommodated in the drying region of the roller pair of the invention. For the same roller length and available space, therefore, the drying effectiveness can be increased with the system of the invention and the energy consumption significantly reduced. Because generally shorter roller pairs can be used, replacement and maintenance is simplified.

The textile data for spun yarn of the example correspond to those for continuous process yarns and the spinning machine has been found to be effective for the viscose process as well as for the wet-spinning process with or without air gaps, including, for example, the solution spinning process and the NMMO process.

I claim:

1. A spinning machine for continuous production of a filament, comprising:

means for wet-spinning an extruded filament;

at least one roller pair of mutually inclined longitudinally extending rollers for receiving said extruded filament and processing said filament, said roller pair defining axially therealong a wet zone initially receiving said filament and a drying zone downstream of said wet zone in a direction of travel of successive turns of said filament looped around said rollers of said pair, said turns progressively advancing in said direction along said rollers, the axes of said rollers being skew to one another and having projections in a vertical plane including an angle between said axes and projections in a horizontal plane including an angle between said axes, said rollers consisting of a main roller and an auxiliary roller of a smaller diameter than said main roller, a ratio of diameters of said auxiliary roller to said main roller being substantially between 1:2 and 1:4, one of said rollers being substantially horizontal and vertical projections of said axes intersecting substantially at one third of the lengths of said rollers, said rollers being journaled at bearing locations at ends of said rollers, coordinates of said bearing locations of the other of the rollers being offset from corresponding coordinates thereof in an imaginary coplanar orientation of said rollers and an imaginary parallel orientation of said rollers in two mutually perpendicular coordinate directions.

2. The spinning machine defined in claim 1 wherein said one of said rollers is said main roller and said other of said rollers is said auxiliary roller.

3. The spinning machine defined in claim 2 wherein said rollers define a deacidification zone between said wet zone and said drying zone, further comprising means at said deacidification zone for washing said filament with water.

4. The spinning machine defined in claim 3 wherein at least one of said rollers conically widens in said direction over a portion of a length thereof.

5. The spinning machine defined in claim 4 wherein said portion corresponds to said deacidification zone.

6. The spinning machine defined in claim 1 wherein said means for wet-spinning an extruded filament comprises extrusion orifice means for extruding said filament, and a coagulating bath receiving an extruded filament from said orifice means and feeding a coagulated filament to said wet zone.

* * * * *